US006082878A

United States Patent [19]

Doubek et al.

[11] Patent Number: 6,082,878

[45] Date of Patent: Jul. 4, 2000

[54] FULLY ROTATABLE RECESSED LIGHT FIXTURE WITH MOVABLE STOP AND ADJUSTABLE LENGTH BAR HANGER

[75] Inventors: David Edwin Doubek, LaGrange; Ken Walter Czech, Itasca; Louise Mamerow Gardner, Arlington Heights; David Jude Ziobro, Elk Grove; Rick Otto Meyer, Hofman Estates, all of Ill.

[73] Assignee: Cooper Industries, Inc., Houston, Tex.

[21] Appl. No.: 09/017,656

[22] Filed: Feb. 3, 1998

[51] Int. Cl.[7] ..... F21V 17/00

[52] U.S. Cl. ..... 362/365; 362/362; 362/364; 362/368; 211/26; 211/71

[58] Field of Search ..... 362/317, 364, 362/365, 366, 368, 371, 372, 373, 382, 287, 275, 432, 404, 418; 248/323, 339, 343, 610, 693; 211/26, 71

[56] References Cited

U.S. PATENT DOCUMENTS

| | | | |
|---|---|---|---|
| 1,350,295 | 8/1920 | Champeau . | |
| 1,821,733 | 9/1931 | Thibodeau . | |
| 2,887,568 | 5/1959 | Franck . | |
| 3,040,172 | 6/1962 | Chan . | |
| 3,300,634 | 1/1967 | Liberman | 362/365 |
| 4,190,355 | 2/1980 | Avery et al. . | |
| 4,290,098 | 9/1981 | Pierson . | |
| 4,408,262 | 10/1983 | Kusmer | 362/147 |
| 4,475,147 | 10/1984 | Kristofek . | |
| 4,519,019 | 5/1985 | Hall . | |
| 4,545,000 | 10/1985 | Fraley et al. . | |
| 4,564,888 | 1/1986 | Lewin et al. . | |
| 4,566,057 | 1/1986 | Druffel . | |
| 4,569,003 | 2/1986 | Elmer et al. . | |
| 4,670,822 | 6/1987 | Baker . | |
| 4,742,440 | 5/1988 | Guzzini . | |
| 4,754,377 | 6/1988 | Wenman . | |
| 4,760,510 | 7/1988 | Lahti . | |
| 4,796,169 | 1/1989 | Shemitz . | |
| 4,872,097 | 10/1989 | Miller . | |
| 4,930,054 | 5/1990 | Krebs . | |
| 4,972,339 | 11/1990 | Gabrius . | |
| 5,034,867 | 7/1991 | Mayer . | |
| 5,073,845 | 12/1991 | Aubrey . | |
| 5,075,828 | 12/1991 | Gordin et al. . | |
| 5,130,913 | 7/1992 | David . | |
| 5,222,800 | 6/1993 | Chan et al. . | |
| 5,374,812 | 12/1994 | Chan et al. . | |
| 5,452,816 | 9/1995 | Chan et al. . | |
| 5,571,256 | 11/1996 | Good et al. | 211/26 |
| 5,581,448 | 12/1996 | Harwood . | |
| 5,588,737 | 12/1996 | Kusmer . | |
| 5,597,234 | 1/1997 | Winkelhake . | |
| 5,662,413 | 9/1997 | Akiyama . | |
| 5,738,436 | 4/1998 | Cummings et al. . | |
| 5,758,959 | 6/1998 | Sieczkowski . | |
| 5,800,051 | 9/1998 | Gampe et al. . | |
| 5,826,970 | 10/1998 | Keller et al. . | |

OTHER PUBLICATIONS

Robert O. Parmley, P.E.; Standard Handbook of Fastening and Joining, second edition; McGraw–Hill Publishing; pp. 8–29 to 8–31, 1989.

*Primary Examiner*—Sandra O'Shea
*Assistant Examiner*—Ismael Negron
*Attorney, Agent, or Firm*—Fish & Richardson P.C.

[57] ABSTRACT

An adjustable recessed light fixture comprises a lamp positionable in orientations wherein the light beam is inclined obliquely relative to a vertical axis, and wherein the inclined light beam can be rotated about the vertical axis. A movable stop is provided which enables the lamp to be rotated in a complete 360° range of rotation. A housing which covers the light fixture includes a removable top wall which provides an effective thermal insulation for the housing. A trim ring is installable such that torsion springs of the trim ring are effectively held within a rotatable spin disc of the light fixture. The lamp can be rotated about a horizontal axis in a manner wherein only a minimal portion of a light beam is cut off by a reflector. A bar hanger for hanging a light fixture frame to a ceiling joist includes relatively slidable rails, wherein ends of the rails can be broken off to shorten the bar hanger without having to disconnect the rails from one another.

30 Claims, 10 Drawing Sheets

FIG. 6
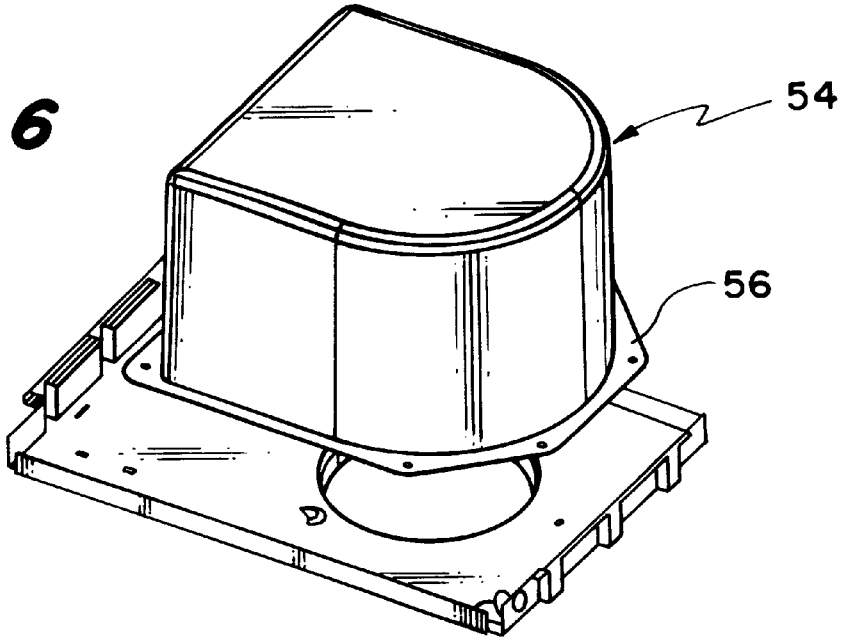
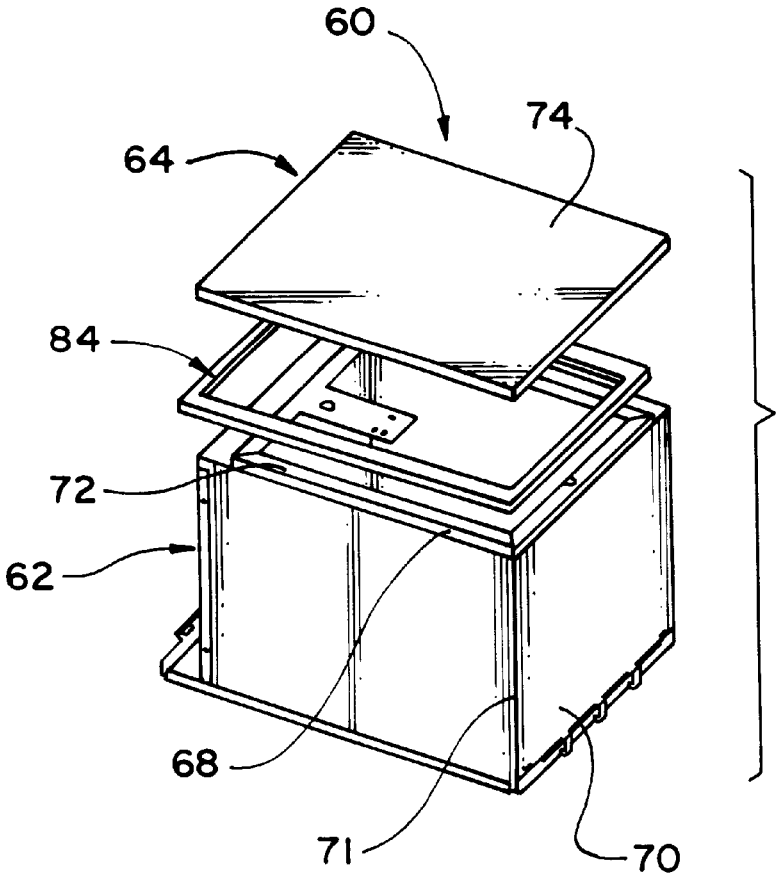
FIG. 7

FIG. 20
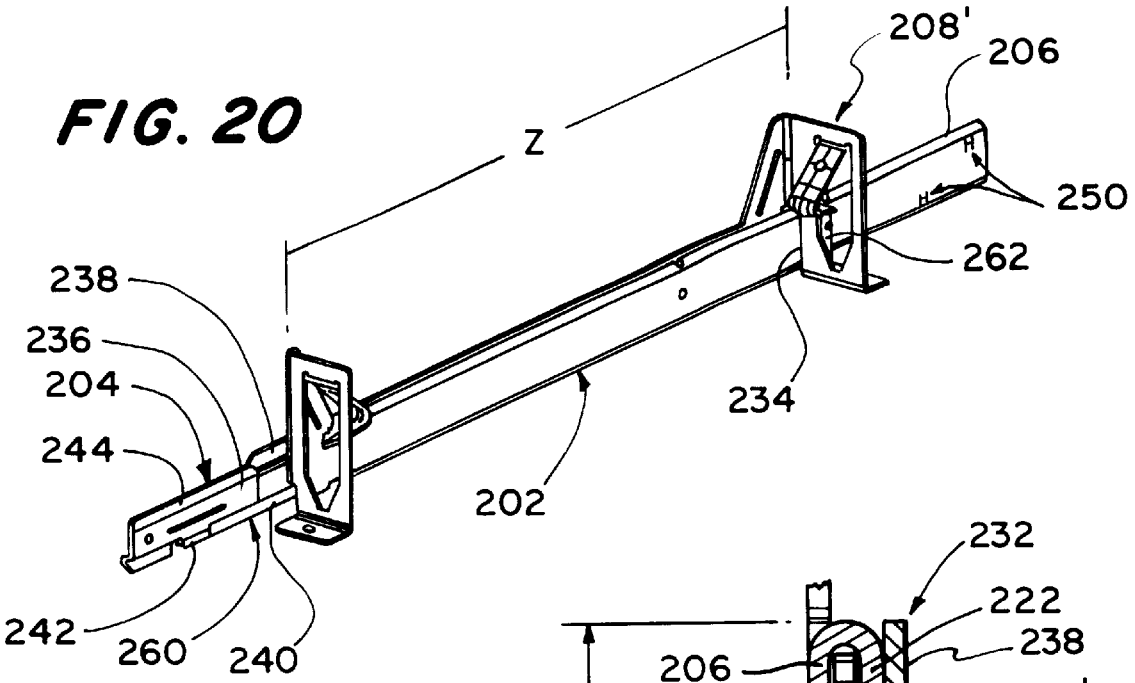
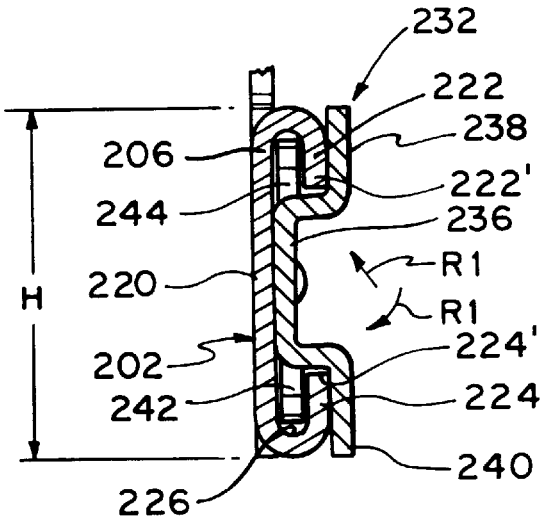
FIG. 22
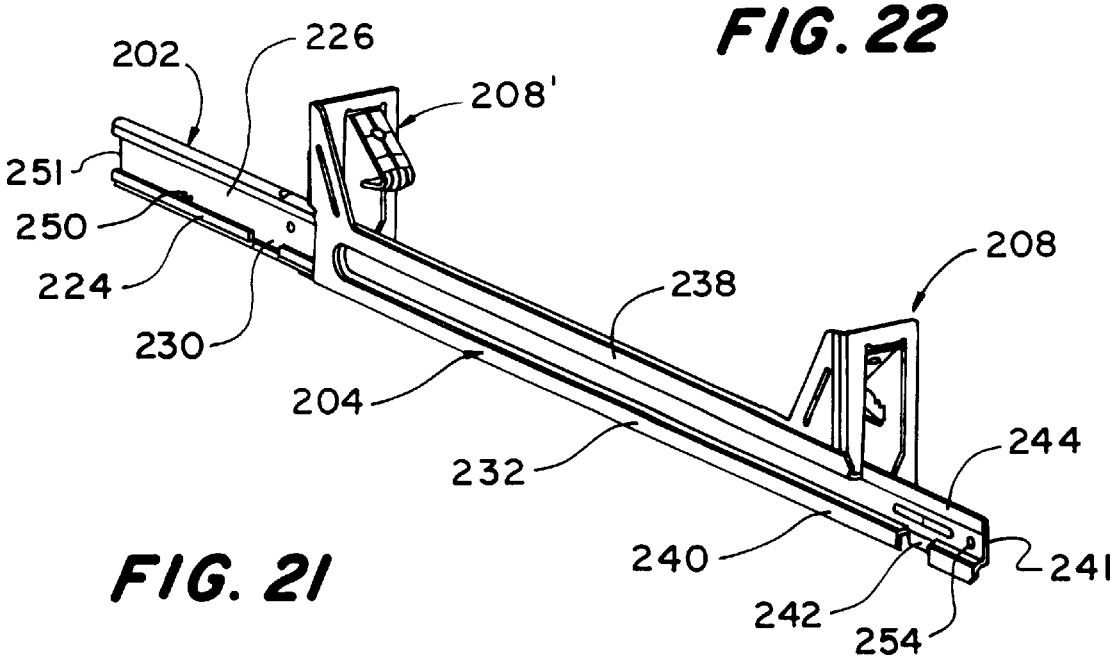
FIG. 21

FULLY ROTATABLE RECESSED LIGHT FIXTURE WITH MOVABLE STOP AND ADJUSTABLE LENGTH BAR HANGER

BACKGROUND OF THE INVENTION

The present invention relates to light fixtures, and especially to an adjustable recessed light fixture adapted to mount a lamp for directing a beam vertically downwardly or at an inclination relative to vertical, the inclined beam being rotatable about a vertical axis.

Such light fixtures are known wherein a horizontal frame is attached to wooden ceiling joists by bar hangers. The frame includes an aperture, and a ring is mounted in the aperture for rotation about a vertical axis. Mounted on the ring is a lamp supporting member which can be adjustably rotated relative to the ring about a horizontal axis. A lamp mounted on the lamp-supporting member is oriented to direct a beam downwardly through the aperture. By rotating the lamp-supporting member about the horizontal axis, the beam direction can be adjusted from a vertical orientation to an orientation inclined relative to vertical. By rotating the ring about the vertical axis while the beam is in an inclined orientation, the beam can be directed to a desired location.

In order to prevent damage occurring to wires connected to the lamp if the ring were continuously rotated in one direction (thus winding-up the wires), a stop is typically provided for limiting rotation in either direction. However, since the stop will, of necessity, have a certain dimension in the direction of rotation of the ring, the ring will not be able to be rotated by a full 360 degrees. In other words, there will be a region of a few degrees in which the beam cannot be directed, thereby possibly creating an inconvenience for the user.

In another aspect of a recessed light fixture, the lamp-supporting member is frequently covered by a housing (or can) which is seated on the frame, in order to restrict the flow of heat from the lamp to the ceiling plenum. In order to minimize air flow past the housing, a gasket is disposed between the frame and a lower edge of the housing. This, however, adds to the cost of the fixture and the complexity of assembly.

In some cases it is desirable to provide access to the lamp from above the frame (top access) by providing the housing with a removable top. However, the presence of such a removable top complicates efforts to minimize air flow through the housing while preventing overheating of the outer skin of the housing.

Another aspect of adjustable recessed light fixtures involves the fact that the lamp is often used in conjunction with a reflector of the type having an upper opening lying in a plane oriented obliquely relative to vertical. It is required that the fixture be installed in a manner ensuring that the lamp is properly oriented with respect to that inclined upper aperture. This makes the installation process more difficult.

Also, a trim ring is usually provided to underlie and cover a bottom edge of the fixture. The trim ring is often held in place by torsion springs. However, such springs can be difficult to install into the frame, and may not provide enough force to hold the trim ring firmly against the ceiling surface.

A further aspect of adjustable light fixtures involves the possibility that a part of the light beam may be cut off by the reflector when the lamp is inclined relative to vertical. That is, an edge of the inclined upper opening of the reflector may cut off an appreciable portion of the beam which reduces the effectiveness and efficiency of the lamp.

Another aspect of recessed light fixtures involves the bar hangers used to mount the frame to the ceiling joists. Those hangers are typically extendable and retractable in order to adapt to different joist spacings. It may sometimes be necessary to break-off part of the hanger to further reduce the length thereof. That procedure can be inconvenient and/or result in the bar hanger being of substantially weakened rigidity.

It would, therefore, be desirable to provide recessed light fixture components which minimize or obviate the above-described shortcomings.

SUMMARY OF THE INVENTION

The present invention relates to a recessed light fixture comprising a frame, a rotary device mounted in the frame for rotation relative thereto about a vertical axis, a support member mounted to the rotary device for rotation therewith about the vertical axis and for rotation relative thereto about a horizontal axis. The support member is adapted to support a lamp for directing a beam downwardly through the rotary device, the direction of the beam being adjustable by rotation of the rotary device and the support member. A stop structure is provided for stopping rotation of the rotary device. The stop structure comprises a first stop element disposed on the rotary device, and a second stop element disposed on the frame. The first and second stop elements are engageable with one another for limiting rotation of the rotary device in both the clockwise and counterclockwise directions of rotation. One of the first and second stop elements, preferably the second stop element, is movable by a limited extent to permit additional rotation of the rotary device after initial contact between the first and second stop elements has been made.

Another aspect of a recessed light fixture according to the present invention comprises a frame having an aperture formed therein, a lamp support mechanism mounted on the frame and projecting above an upwardly facing top surface of the frame for supporting a lamp to direct a light beam downwardly through the aperture, and a housing mounted on the upwardly facing surface of the frame for encasing the lamp support mechanism. A bottom end of the housing is bent laterally (outwardly or inwardly) to form a flange having a downwardly facing surface extending completely around the perimeter of the bottom end and engaging the upwardly facing surface of the frame to retard the travel of air and promote a conduction of heat to the frame surface from inside of the housing.

Still another aspect of the invention relates to a housing adapted for use in a recessed light fixture for encasing a lamp assembly. The housing comprises a base, a cover, and a gasket. The base includes an upstanding wall structure including inner and outer upstanding wall sections spaced horizontally apart. The outer wall section forms an outer perimeter of the base. The inner wall section is formed of metal. An upper end of the inner wall section is bent inwardly to form a horizontal flange. The cover is fastened to the base by fasteners. The cover includes a horizontal wall structure formed by upper and lower wall sections. The lower wall section is formed of metal and includes a center portion and an outer peripheral portion. The center portion is spaced beneath the upper wall section and rests upon an upwardly facing surface of the flange for conducting heat to the inner wall section. The outer peripheral portion is disposed at a higher elevation than the center portion. The thermally insulative gasket is compressed between a downwardly facing surface of the cover and the upwardly facing surface of the flange for forming a continuous thermal seal between the lower and inner wall sections.

Still another aspect of the invention relates to a recessed light fixture comprising a horizontal frame, a spin disc, and a supporting mechanism. The frame has an aperture in which the spin disk is mounted for rotation about a vertical axis. The spin disc includes a circular inner edge having more than two notches formed therein. The notches are non-equidistantly spaced apart. The inner edge includes a downwardly projecting aiming tab. The supporting mechanism is adapted to support a lamp and includes a ring and a supporting member. The ring is disposed within the disc and carries a plurality of spring clips connected within respective ones of the notches for fixing the ring to the spin disc for rotation therewith. The supporting member includes a table adapted to support a lamp for projecting a light beam downwardly through the aperture. The supporting member is mounted on the ring for rotation about a horizontal axis, whereby the light beam can be adjusted up and down in the general direction of the aiming tab.

Still another aspect of the invention relates to a recessed light fixture comprising a horizontal frame, a spin disc, a lamp supporting member, and a trim ring. The frame has an aperture in which the spin disc is mounted for rotation about a vertical axis. The spin disc includes a pair of diametrically opposed guide channels. Each guide channel includes a pair of opposed vertical guide surfaces each having an upwardly open notch formed in an upper end thereof. The lamp supporting member is mounted to the spin disc for rotation therewith and is adapted to support a lamp assembly. The supporting member is rotatable about a horizontal axis to adjust an inclination of a light beam projected downwardly through the aperture. The trim ring includes a pair of diametrically opposed torsion springs. Each torsion spring includes a pair of legs elastically movable toward one another. Each leg is disposed in a respective one of the notches.

Another aspect of the present invention relates to a recessed light fixture comprising a horizontal frame, a spin disc, a reflector, and a supporting member. The frame has an aperture defining a vertical center axis. The spin disc is mounted in the aperture for rotation about the vertical axis. The reflector is mounted to the spin disc for rotation therewith and includes an opening formed within a plane oriented at an oblique angle with respect to vertical, whereby the reflector includes tall and short sides opposing one another. The reflector includes a bottom edge disposed in a horizontal plane intersected by the vertical axis at a point of intersection. The supporting member supports a lamp above the reflector and is mounted to the spin disc for rotation therewith about the vertical axis and for rotation relative to the spin disc about a horizontal axis. The supporting member is rotatable from a first position wherein a center axis of a light beam of the light extends vertically downwardly substantially through the point of intersection, to a second position wherein the lamp approaches the short side and the light beam becomes oriented obliquely relative to vertical. The horizontal axis is spaced from the vertical axis in a direction toward the tall side, whereby when the lamp is moved from the first position to the second position, the lamp travels closer to the point of intersection, while the center line of the beam continues to pass substantially through the point of intersection.

A further aspect of the present invention relates to an adjustable-length bar hanger adapted to mount a light fixture frame to ceiling joists. The bar hanger comprises first and second bar elements interconnected for relative sliding movement in a longitudinal direction for selectively adjusting an overall length of the bar hanger. The first bar element comprises a first rail having a mounting end and a free end. The mounting end includes a first bracket extending transversely of the longitudinal direction and adapted to be affixed to a wooden ceiling joist. The second bar element comprises a second rail having a mounting end and a free end. The mounting end of the second rail includes a second bracket extending transversely of the longitudinal direction and adapted to be connected to a wooden ceiling joist. The first rail includes a guide structure for guiding the second rail in longitudinal sliding movement relative thereto, with the free ends of the first and second rails overlapping each other in a zone defined between the first and second brackets. The guide structure permits the first and second rails to be slid longitudinally relative to one another to a state where both of the first and second free ends extend beyond the zone, whereby the first and second free ends can be broken off to shorten the overall hanger length while the first and second bar elements remain in an interconnected state.

Another aspect of the invention relates to an adjustable-length bar hanger adapted to mount a light fixture frame to ceiling joists. The bar hanger comprises first and second bar elements interconnected for relative sliding movement in a longitudinal direction for selectively adjusting an overall length of the bar hanger. The first bar element comprises a first rail having a mounting end and a free end. The mounting end includes a first bracket extending transversely of the longitudinal direction and adapted to be affixed to a wooden ceiling joist. The second bar element comprises a second rail having a mounting end and a free end. The mounting end of the second rail includes a second bracket extending transversely of the longitudinal direction and adapted to be affixed to a wooden ceiling joist. The first rail includes a longitudinal channel for guiding the second rail in longitudinal sliding movement relative thereto. The first rail is of general C-shaped cross-section, the C-shape formed by a vertical wall and a pair of upper and lower vertical lips extending parallel to and spaced from the vertical wall. The upper and lower lips have respective end faces facing one another and spaced vertically apart to form therebetween an opening leading to the channel. The second rail includes a projection extending into the channel through the opening, and upper and lower vertical legs disposed outside of the channel and extending alongside of the upper and lower lips, respectively. The end faces of the upper and lower lips are arranged to engage upper and lower surfaces, respectively, of the projection.

BRIEF DESCRIPTION OF THE DRAWING

The objects and advantages of the invention will become apparent from the following detailed description of preferred embodiments thereof in connection with the accompanying drawing in which like numerals designate like elements and in which:

FIG. 6 is a top exploded perspective view of another housing shape according to the present invention;

FIG. 7 is a top exploded perspective view of a top access housing for use in a recessed light fixture according to the present invention;

FIG. 3 is a bottom plan view of a fragment of the spin disc showing the manner of connection of a torsion spring therein;

FIG. 20 is a perspective view of the bar hanger in a retracted position for cutting off pieces thereof according to the present invention;

FIG. 21 is a view similar to FIG. 20 taken in a different direction;

FIG. 22 is a cross-sectional view taken along the line 22—22 in FIG. 20;

DETAILED DESCRIPTION OF PREFERRED EMBODIMENTS OF THE INVENTION

Figure 1:
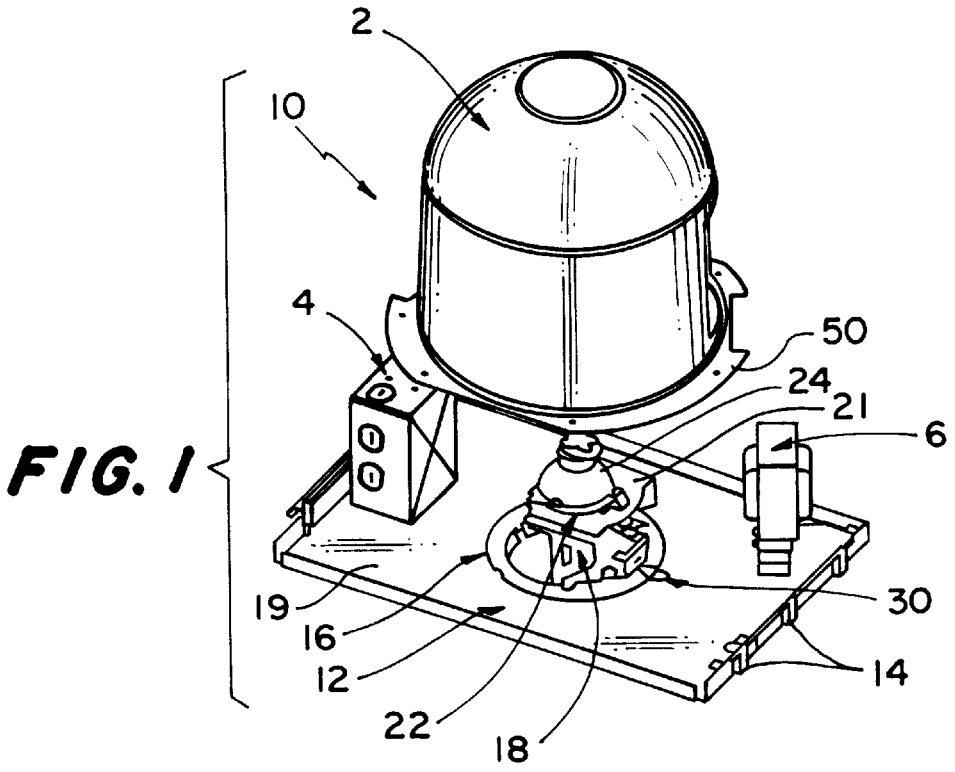
FIG. 1 is a top exploded perspective view of an adjustable recessed light fixture according to the present invention.
Figure 17:
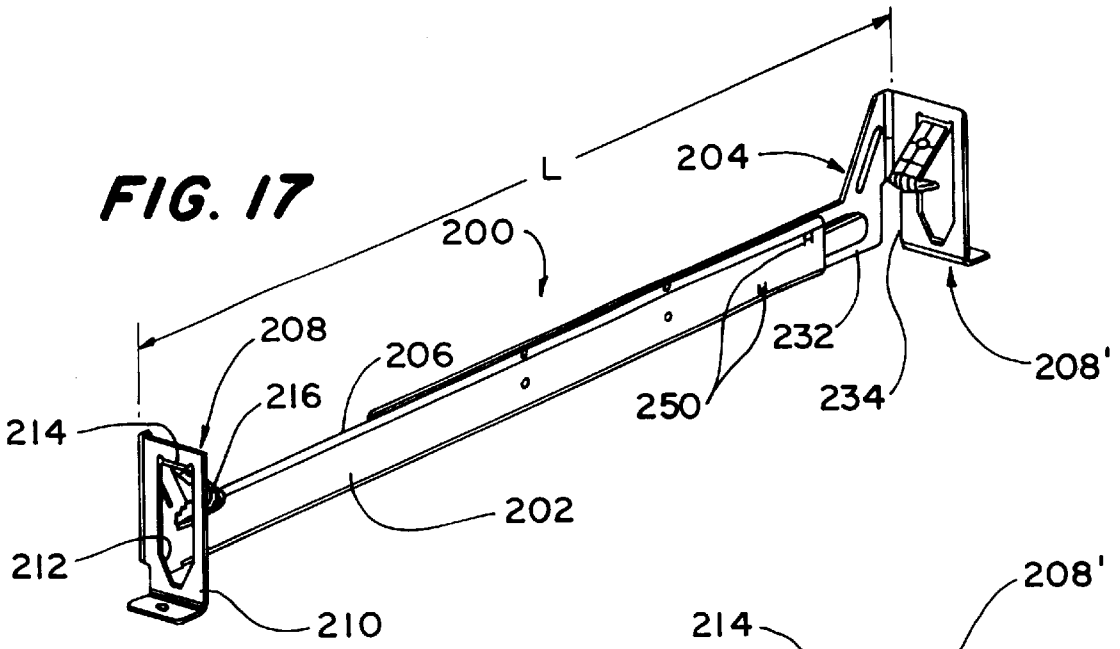
FIG. 17 is a perspective view of a bar hanger according to the present invention.
Figure 19:
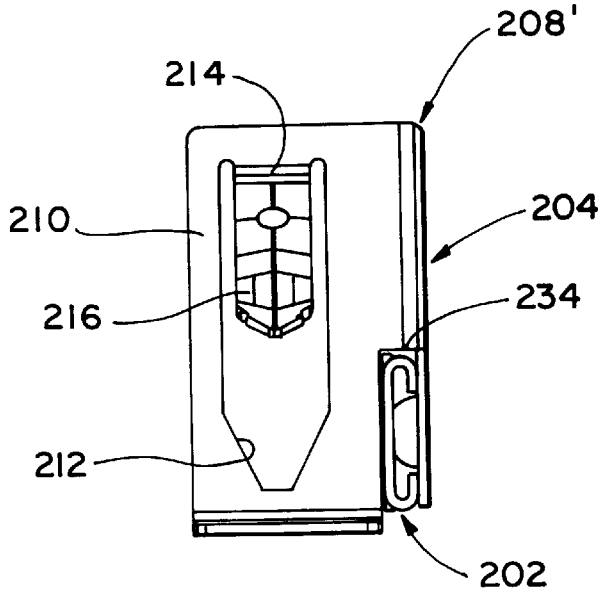
FIG. 19 is an end view of the bar hanger depicted in FIG. 17.

Depicted in FIG. 1 is a recessed light fixture 10 in which the direction of the lamp beam is adjustable to different angles relative to vertical, as well as being rotatable about a vertical axis. The fixture 10 includes a frame 12 which includes loops 14 affixed along side edges thereof, the loops adapted to receive adjustable bar hangers 200 (see FIG. 17) for attaching the frame to ceiling joists.

A rotary device 16 (see also FIGS. 2–4) is mounted in a circular aperture of the frame for rotation about a vertical axis. Mounted on the rotary device is a support member 18 which projects above an upwardly facing top surface 19 of the frame. The support member 18 is rotatable relative to the rotary ring about a horizontal axis A1 (see FIG. 2) located at lower ends of two vertical legs 20 of the support member 18. Mounted on a table portion 21 of the support member 18 is a lamp assembly 22 (shown in FIG. 1) which includes a heat shield 24, a downwardly projecting lamp (not shown) disposed within the heat shield, and a lens (not shown) covering a bottom of the lamp. The lamp assembly is described in greater detail in U.S. application Ser. No. 08/796,583 filed Feb. 6, 1997, the disclosure of which is incorporated herein by reference. The lamp projects a beam downwardly through an aperture 26 formed in the table portion 21.

An inner housing or can 2 is fastened to the frame 12 by screws or rivets 23 (FIG. 5) to encase the light assembly 22 and resist the transfer of heat above the ceiling plenum.

It will be appreciated that by rotating the support member 18 about the horizontal axis A1, the inclination of the light beam relative to vertical can be varied. By rotating the rotary device 16 about a vertical axis when the beam is inclined, the beam can be swung in a circular pattern.

If the device 16 were able to be continuously rotated in either direction, it is possible that the wiring connected to the lamp could become twisted and damaged.

Stop Mechanism

Therefore, in order to prevent such continuous rotation, a stop 30 is provided engaging a part of the rotary 16, e.g., any suitable type of projection, such as an upstanding tab 32 for terminating the rotation of the rotary device 16 in either direction. The tab 32 and stop 30 constitute first and second stop elements, respectively.

It will be appreciated that the stop 30 can be engaged by the tab 32 when the rotary device is rotated either clockwise or counterclockwise. If the stop 30 were fixed (immovable) as in the prior art, it will be appreciated that the distance D shown in FIG. 2 would represent a region in which the tab 32 could not enter. That is, the rotary device 16 could rotate in a range equal to 360° minus D. Even though the distance D is small, i.e., even though the range of rotation of the rotary device may be only a few degrees short of a full 360 degree range, it can be of considerable inconvenience to a user who cannot aim the beam directly where he/she wishes, due to the presence of the stop.

The stop 30 according to the present invention, however, eliminates that shortcoming. In that regard, the stop 30 includes a mounting portion 34 which includes a hole 36 for receiving a pivot pin or rivet that enables the stop to freely rotate about a vertical axis A2 (within certain limits as will be discussed). The stop also includes a contact portion 38 which overlies the rotary device 16 and is adapted to be contacted by the tab 32 of the rotary device 16. The contact portion 38 is disposed higher than the mounting portion 34 to form a step 40 therebetween, the step being spaced slightly from an outer edge 42 of the rotary device 16.

Figure 2:
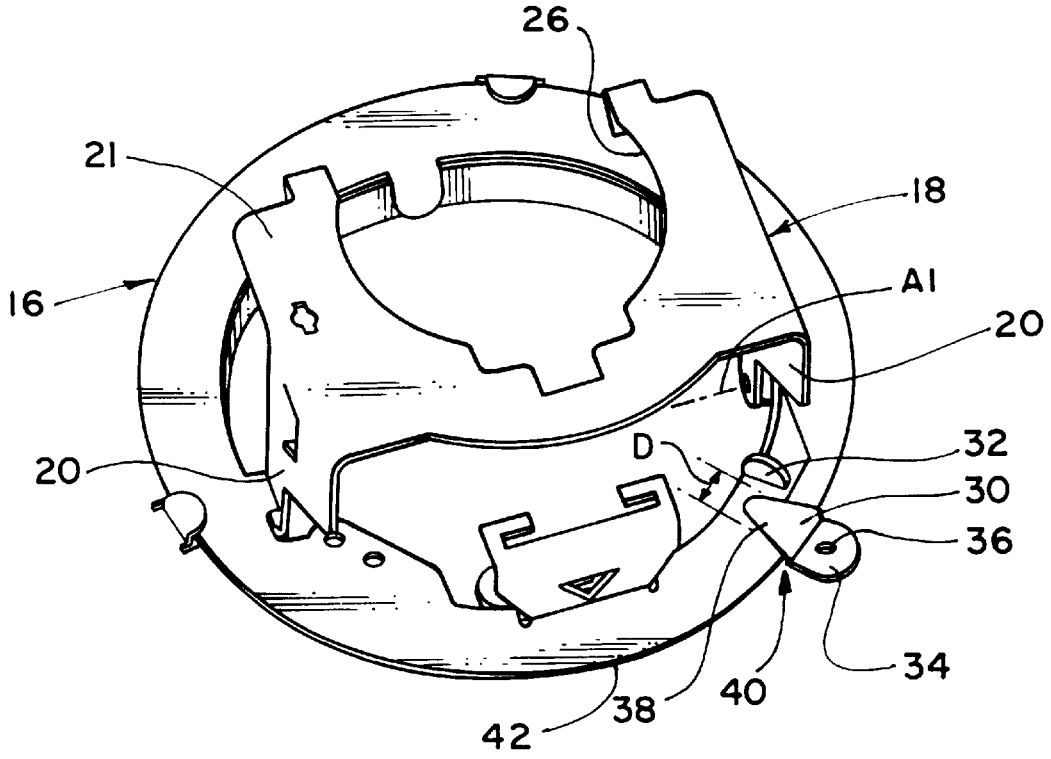
FIG. 2 is a top exploded perspective view of a spin disc employed in the fixture of FIG. 1.
Figure 3:
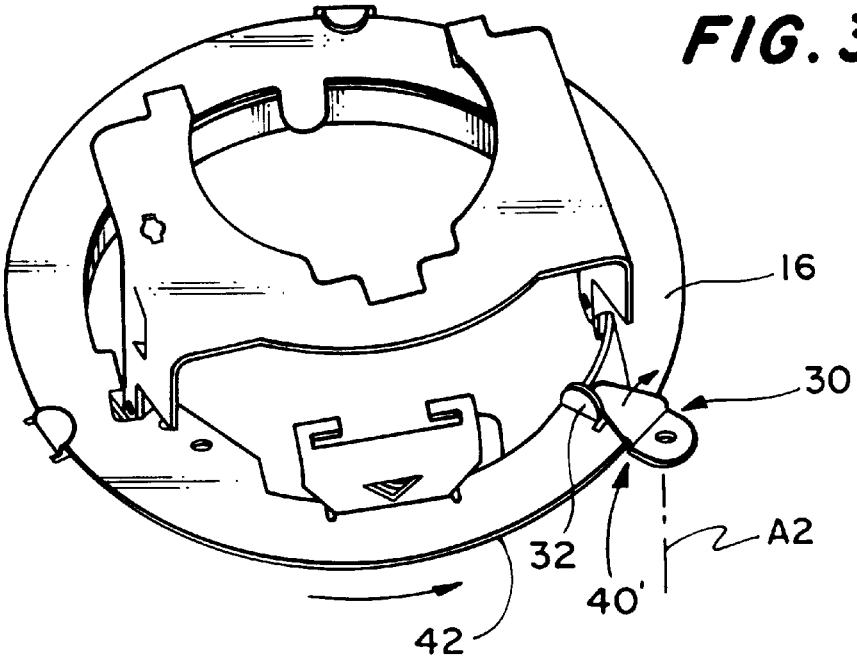
FIG. 3 is a view similar to FIG. 2 wherein a tab of the spring disc engages a stop element during rotation in a counterclockwise direction.
Figure 4:
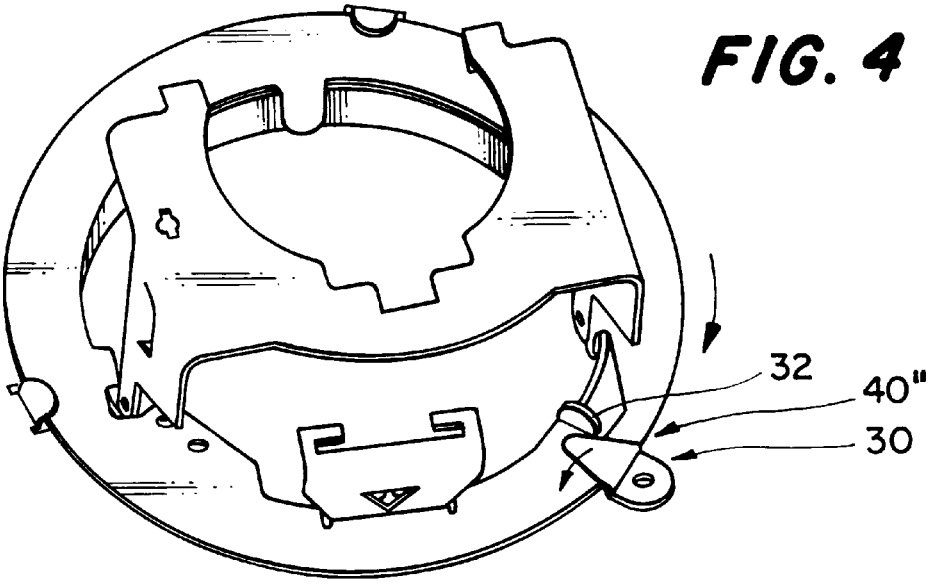
FIG. 4 is a view similar to FIG. 2 wherein the tab engages the stop member during rotation in a clockwise direction.

In operation, when a user rotates the rotary device 16 counterclockwise in FIG. 3 while attempting to aim the light beam, causing the tab 32 to abut the stop 30, the stop is pivoted about the axis A2 in a clockwise direction, thereby permitting the rotary device 16 to rotate farther than it otherwise could have. The rotation of the stop 30 occurs until an end 40' of the step 40 abuts the edge 42 as shown in FIG. 3. Similarly, if the rotary device 16 abutted the stop 30 while being rotated clockwise, as shown in FIG. 4, the stop 30 would pivot counterclockwise until the opposite end 40" of the step 40 abutted the edge 42. The stop 30 can be permitted to rotate in either direction by an extent sufficient to enable the tab 32 to traverse all or at least one-half of the distance D (FIG. 2). If the rotation of the stop in either direction is sufficient to permit the tab to traverse one-half of the distance D, then it will be ensured that the combined extent of stop rotation in both directions will enable the tab to traverse the entire distance D.

Accordingly, a user will be able to aim a beam in virtually any direction within a 360 degree range.

Air-Tight Housing

Figure 5:
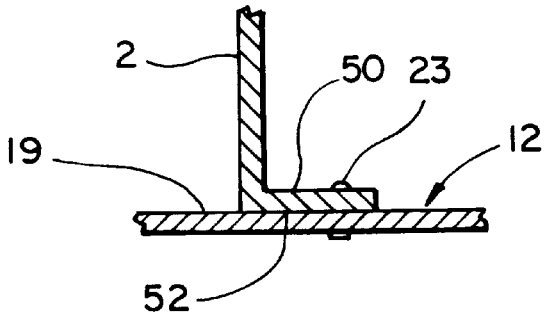
FIG. 5 is a sectional view of an engagement between a housing and frame of a recessed light fixture according to the present invention.

The housing 2, which is formed of metal, has a bottom end that is bent laterally outwardly (or inwardly) at a ninety degree angle to form a flange 50 extending completely around the bottom perimeter of the housing 2. A downwardly facing surface of the flange 50 makes contact with the upwardly facing surface 19 of the frame 12 along an interface 52, as shown in FIG. 5, to resist the flow of air and improve the conduction of heat internal to the housing 2. Accordingly, an improved conduction of heat to the frame surface area retards the flow of heat into the ceiling plenum, making it possible for the fixture to comply with applicable maximum temperature restrictions and air flow regulations relating to recessed light fixtures. The surface-to-surface contact at 52 provides a satisfactory retarding of air flow and improved heat conduction without the need for a gasket.

Although the housing 2 depicted in FIG. 2 is generally cylindrical, the invention also pertains to housings of other shapes, such as rectangular housing or a combined rectangular/cylindrical shaped housing 54 having a flange 56, as shown in FIG. 6.

Top Access Housing

Figure 8:
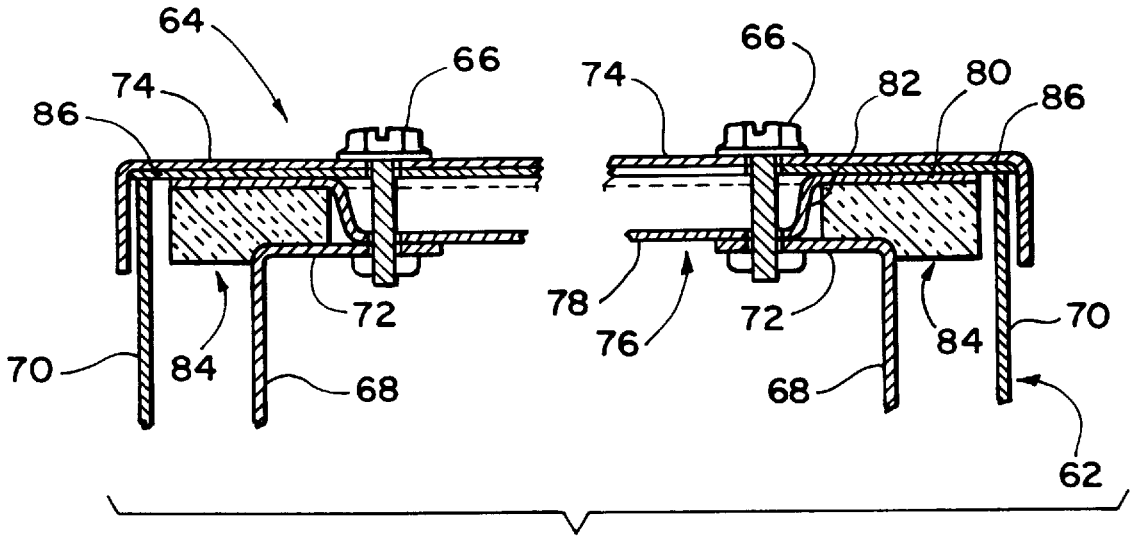
FIG. 8 is a vertical sectional view taken through an upper portion on of the housing depicted in FIG. 7.

In the recessed fixture heretofore described, relamping is intended to be performed from below the frame. Depicted in FIGS. 7 and 8, however, is a housing 60 which enables relamping to be performed from above the frame. That top-access housing 60 comprises a metal base 62 and a removable metal cover 64 which is attached to the base 62 by means of fasteners such as screws 66. The base includes an upstanding wall structure including an inner upstanding wall section 68, and an outer upstanding wall section 70 spaced horizontally from the inner wall section 68. Each of the inner and outer wall sections 68, 70 is bent at four vertical corners 71 to form a rectangular box-like configuration. An upper end of the inner wall section 68 is bent inwardly to form a horizontal flange 72. The flange 72 defines an outer perimeter of an upper opening of the base.

The cover 64 includes a horizontal wall structure formed by an upper wall section 74 and a lower wall section 76. The lower wall section 76 includes a center portion 78 and an outer peripheral portion 80 disposed at a higher elevation than the center portion 78, whereby a step 82 is formed between those portions 78, 80. The center portion is spaced beneath the upper wall section 74 and rests upon an upwardly facing surface of the flange 72. Each screw 66 extends through the upper wall section 74, the center portion 78, and the flange 72.

Compressed between a downwardly facing surface of the outer peripheral portion 80 and the upwardly facing surface of the flange 72 is a rectangular gasket 84 formed of a thermally insulative material for forming a continuous thermal seal between the lower wall section 76 and the inner wall section 68. A heat insulative pad 86 covers the upper wall section and is compressed between that upper wall section 74 and the outer peripheral portion 80 of the lower wall section 76.

When the cover 64 is installed on the base 62 by the fasteners 66, and the lamp (not shown) is illuminated, heat emitted by the lamp rises and heats the center portion 78 of the lower wall section 76. That heat is conducted outwardly to the interface between the center portion 78 and the flange 72 and is transferred to the flange 72 and thus is distributed along the inner wall section 68. Very little heat is conducted along the step 82 to the outer peripheral portion 80 of the lower wall section, and any heat which is so conducted is isolated from the upper wall section 76 by the gasket 86.

The transfer of the heat upwardly by convection from the center portion 78 to the upper wall section 74 is retarded by the air gap formed therebetween.

Furthermore, heat cannot escape by convection between the cover 64 and the base 62 due to the presence of the gasket 84.

As a result of that arrangement, the outermost skin of the base 62 and cover 64, defined by the outer wall section 70 and upper wall section 74, respectively, will not become excessively heated.

Self-Aligning Adjustment Mechanism

Figure 10:
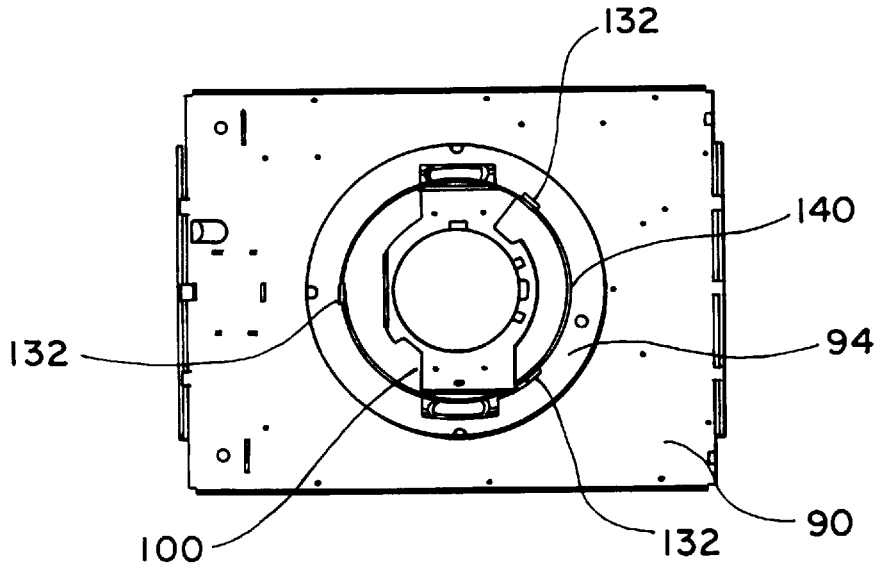
FIG. 10 is a top plan view of the spin disc depicted in FIG. 9 mounted in the frame.
Figure 9:
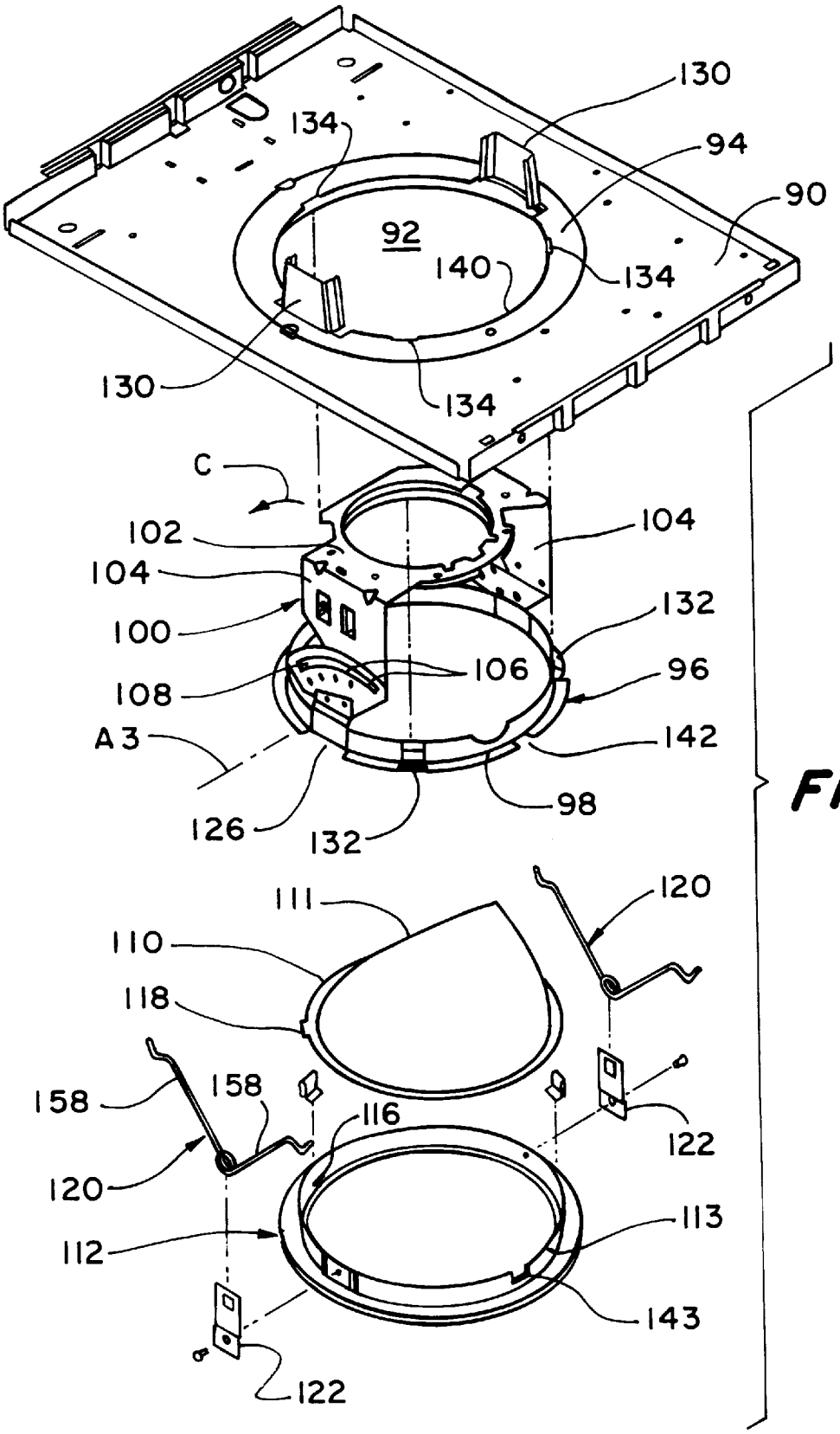
FIG. 9 is an exploded perspective view of an adjustable recessed light fixture including a spin disc according to the present invention.

Depicted in FIGS. 9 and 10 is a frame 90 having an aperture 92 in which a spin disc 94 is mounted for rotation about a vertical axis. The spin disc is adapted to retain an adjustable lamp support mechanism 96. That mechanism 96 includes a ring 98 on which a lamp support member 100 is mounted for rotation. The support member 100 includes a table 102 and a pair of legs 104 projecting downwardly therefrom. Each of the legs includes a pair of projections 106 slidably movable within an arcuate slot 108 formed in a bracket that is affixed to the ring 98. Thus, the support member 100 is rotatable about a horizontal axis A3 defined by the centers of curvature of the slots 108 (only one slot being visible in the drawing). The location of that axis A3 is approximated in FIG. 9.

A lamp assembly (not shown) would be mounted on the table 102 to direct a light beam downwardly through the aperture 92 after the mechanism 96 has been inserted upwardly through the aperture 92.

Also installable from below are a trim ring 112 and reflector 110 seated thereon. The reflector 110 is truncated at its top to form an opening 111 located within a plane oriented at an oblique angle relative to vertical. The trim ring includes an upstanding cylindrical wall 113 containing a vertical slot 116 which receives a tab 118 projecting from the reflector 110 in order to locate the reflector at a proper angular relationship on the trim plate.

It is necessary to provide a proper angular relationship between the lamp and the reflector to ensure that the lamp is always aligned with the opening 111.

The trim ring carries torsion springs 120 that are affixed to brackets 122 which are, in turn, affixed to the trim ring. The trim ring is properly angularly located relative to the ring 98 because the springs 120 fit through respective recesses 126 formed in an outer flange of the ring. Furthermore, the trim plate 112 is properly angularly located relative to the spin disc 94, because the springs 120 are received in respective guide channels 130 of the spin disc 94.

The ring 98 is properly angularly located relative to the spin disc by means of spring tabs 132 mounted on the ring 98 which snap into respective radial notches 134 formed in an inner edge of the spin disc 94, in response to pushing the trim ring upwardly so that the wall 113 enters the ring 98. There are three spring tabs 132 and they are not angularly spaced equidistantly (i.e., by 120 degrees). Rather, they are angularly spaced non-evenly so that the ring 98 can be inserted in only one angular relationship relative to the spin disc.

In order to help an installer align the spring tabs 132 with the proper notches 134, the spin disc 94 is provided with an aiming tab 140 which projects downwardly from the inner edge of the spin disc. That aiming tab is visible to an installer who is looking up at the ceiling, whereby the installer can align a slot 142, formed in the outer flange of the ring, with the tab. When the ring 98 is then pushed upwardly, the tab 140 enters the slot 142 and the spring clips snap into their respective notches 134.

The tab 140 is also received in a slot 143 of the trim ring 112 and is thus visible to a user during installation of the trim ring. The tab 140 is positioned so as to lie in a direction of aiming of the support member 100. That is, a plane oriented perpendicular to the axis A3 and containing the vertical axis of the aperture 92 will bisect the slot 142 and the tab 140. Thus, when a user tilts the support member 100 about the axis A3 (i.e. in a counterclockwise direction C in FIG. 9), a lamp carried by the support member projects a beam at an angle relative to vertical and in the general direction of the tab 140. Accordingly when a user wants to rotate the ring/spin disc unit 98, 94 to aim the beam, the user needs merely to rotate that unit until the tab 140 is directed in the desired direction of aiming. Thus, the tab 140 serves as an aid for installing the ring and for subsequently aiming a light beam.

Spring-Guiding Channels

Figure 11:
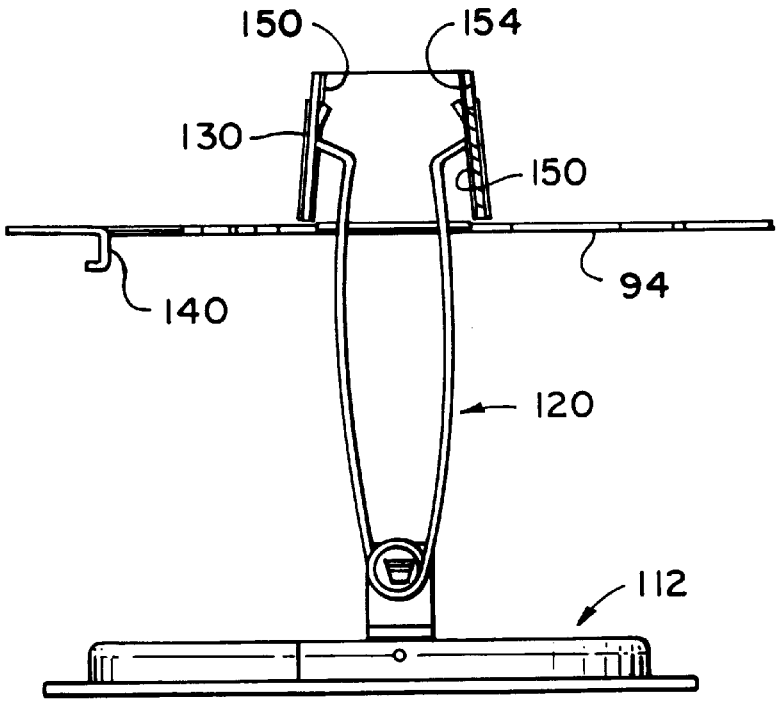
FIG. 11 is a side elevational view, partially in vertical section, of a trim ring in the process of being inserted into the spin disc depicted in FIG. 9.
Figure 12:
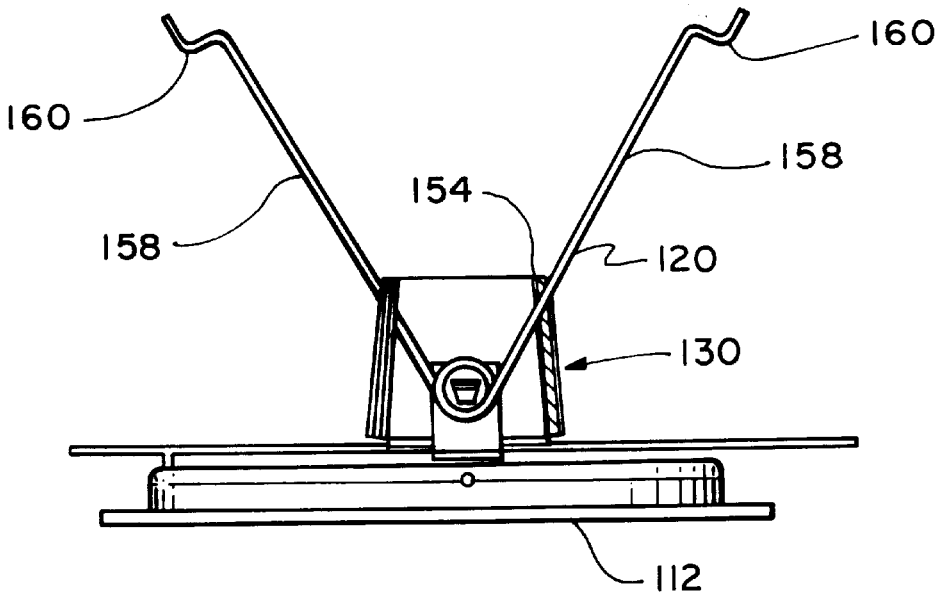
FIG. 12 is a view similar to FIG. 11 after the trim ring has been installed.

As noted earlier, the trim ring 112 is installed after the support mechanism 96 has been installed, whereby the recesses 126 of the ring 98 will be vertically aligned with respective guide channels 130. To install the trim ring, the installer compresses the springs 120, as shown in FIG. 11 and pushes them upwardly through the respective guide channels 130 (Note: the supporting mechanism 96, frame 90, and reflector 110 have been omitted for clarity in FIGS. 11 and 12.)

Figure 13:
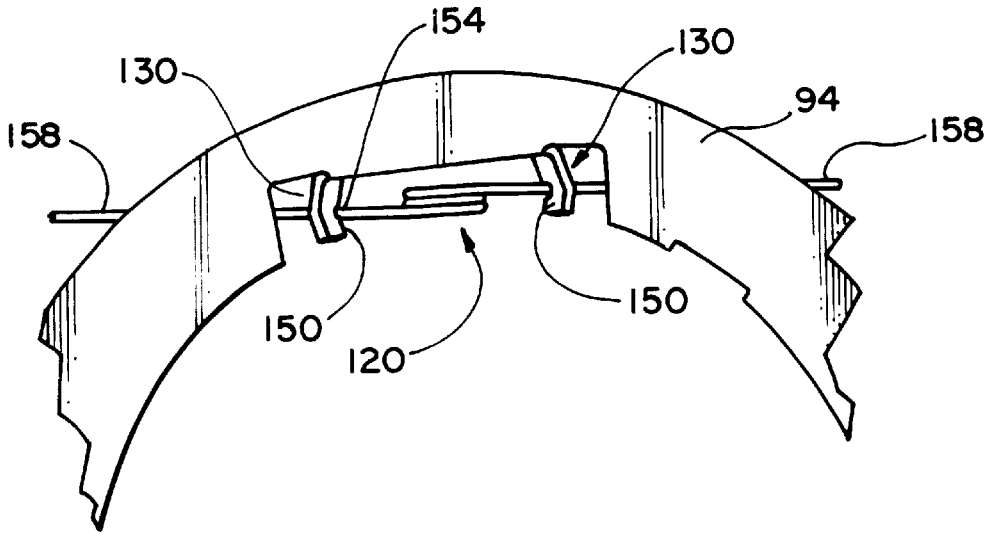

Each guide channel 130 includes a pair of upwardly converging guide surfaces 150 along which the upper ends of a respective spring 120 slides. Each guide surface 150 has portions which converge toward a center of the guide surface as viewed in plan, i.e. the side wall is generally V-shaped in cross section (see FIG. 13). At an upper end of that center where the portions of each guide surface 150 converge, an upwardly open notch 154 is formed.

Each spring 120 comprises two legs 158, a free end of each leg being bent to form a smooth corner 160. Those corners slide along the respective guide surfaces 150 in a manner providing minimum frictional resistance, and no gouging of the guide surfaces.

As a spring 120 travels upwardly along the upwardly converging surfaces, the legs 158 are forced closer together and then spring out into respective notches 154 (see FIG. 12), in order to frictionally secure the trim ring 112 in place. Since the guide surfaces 150 converge toward one another in the upward direction, the distance by which the legs 158 become spaced from one another after springing out into the notches 154 is less than would have been the case if the guide surfaces 150 were not convergent. Thus, the force applied by the sprung spring legs 158 against the guide surfaces is greater, whereby the securement of the trim plate is enhanced. Also, since the spring legs do not spring-out as far as would be the case if the surfaces 150 did not converge, the overall arrangement is more compact, enabling the size of the overlying housing 2 (FIG. 1) to be reduced.

Translating Light Beam

As explained earlier in connection with FIG. 9, the support member 100 which supports a lamp is mounted for rotation about a horizontal axis A3 defined by a line extending through the centers of curvature of the two slots 108. It has been found that the location of that axis can lead to certain advantages.

Figure 14:
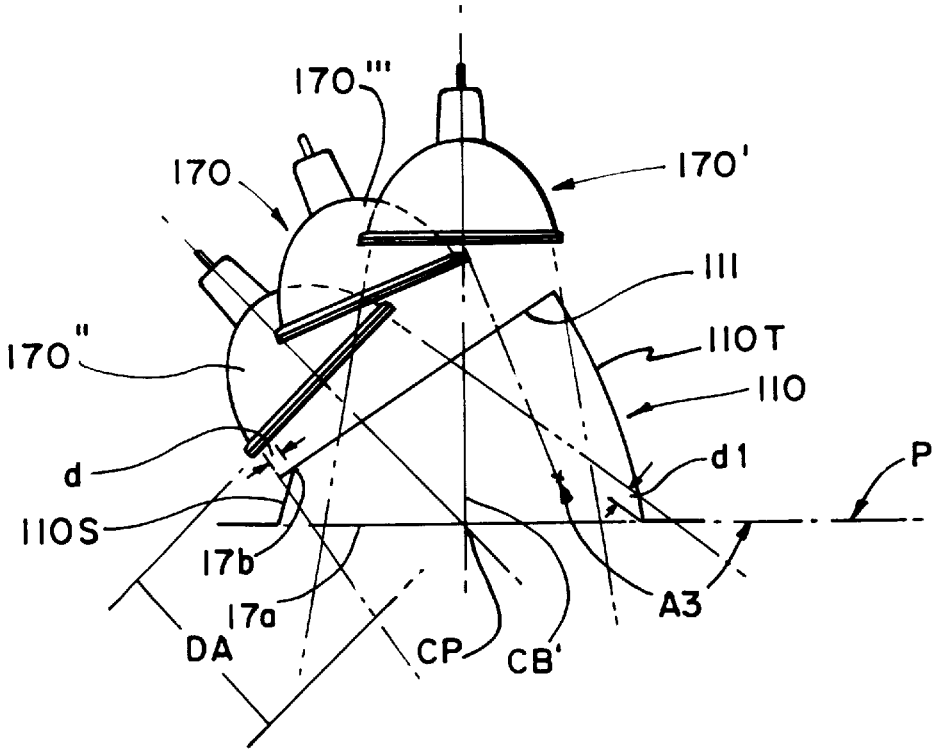
FIG. 14 is a schematic side elevational view depicting the spatial relationship between a reflector and an adjustable lamp in accordance with the present invention.

For instance, with reference to FIG. 14, a lamp 170 supported on the table 102 of the support member 100 (omitted from FIG. 14 for clarity) can swing between an upper position 170' and a lower position 170" and can be held in any intermediate position 170'". In the upper position, the center axis of the light beam is oriented in a vertical direction CB' which intersects a horizontal plane P of a lower aperture 172 of the reflector 110 at a point CP. In the arrangement shown in FIG. 14, the point CP is the geometrical center of the aperture 172.

The axis of rotation A3 of the lamp-supporting member 100 is spaced from the line CB' in a direction of beam aiming, i.e., toward a tall side 110T of the reflector (disposed opposite a short side 110S of the reflector). As a result, when the lamp rotates out of the uppermost position 170' it travels gradually closer to the point CP, i.e. the distance DA gradually becomes shorter. Also, the axis A3 is positioned so that the center of the beam passes substantially through the point CP when the lamp is in any of its possible positions of adjustment, especially its lower position 170". By locating the pivot axis A3 at a distance spaced from the line CB' in the direction of lamp aiming such that the beam axis passes substantially through the point CP when the lamp is in the lower position, there results a reduction in the amount of the light beam which is cut off by the reflector. That is, the lamp will be disposed closer to the edge 176 of the short side 110S, so less of the lower portion of the conical beam will be cut off by that edge. In other words, the distance d is minimized. Also, the amount by which the upper portion of the beam is cut off is also reduced, i.e., the distance d1 is reduced.

Figure 15:
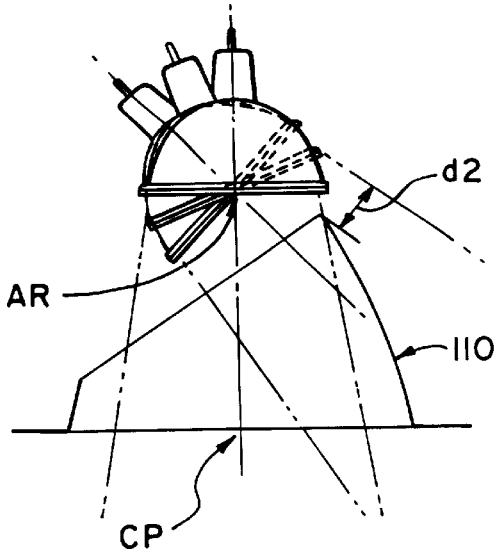
FIG. 15 (PRIOR ART)
FIG. 15 is a view similar to FIG. 14 of a first prior art arrangement.
Figure 16:
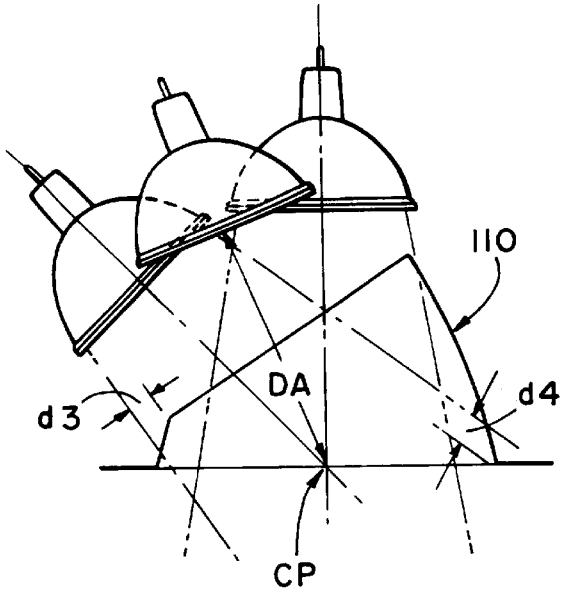
FIG. 16 (PRIOR ART)
FIG. 16 is a view similar to FIG. 14 of a second prior art arrangement.

The advantages of the invention become apparent when comparing the invention with two prior art arrangements shown in FIGS. 15 and 16. In FIG. 15, the axis of rotation AR is located at the center of the front face of the lamp, resulting in a considerable loss of the upper portion of the beam when the lamp is inclined, i.e. distance d2 is relatively large, because the center axis of the beam is spaced substantially from the point CP.

In FIG. 16, the axis of rotation lies at the point CP, whereby the distance DA remains constant as the lamp rotates out of the upper position. That results in a greater loss of the upper and lower portions of the beam than in the present invention. That is, distances d3 and d4 of FIG. 16 are greater than distances d and d1, respectively of FIG. 14.

It should be noted that although the axis A3 is shown in FIG. 14 as disposed above the plane P, i.e. situated inside of the reflector 110, it could instead be situated below the plane P, as long as: (1) the axis is spaced from the line CB' toward the beam-aiming direction (i.e., to the right in FIG. 14), and (2) the center axis of the beam passes substantially through the point CP, especially when the lamp is in the lower position.

Furthermore, although the axis A3 has been described as being fixed (stationary) during rotation of the lamp (i.e. the slot 108 in FIG. 9 has a constant radius of curvature), it is possible within the scope of the invention that the position of the axis A3 could be variable, i.e., the slot 108 could extend along an elliptical path, whereby the position of the axis A3 would constantly change during rotation of the lamp-supporting member 100.

Slide-Through Bar Hanger

As pointed out earlier in connection with FIG. 1, opposing edges of the frame 12 include loops 14 for receiving adjustable bar hangers to attach the fixture to joists of a ceiling structure.

An adjustable bar hanger 200 according to the present invention is depicted in FIGS. 17–22. The bar hanger 200 consists of first and second bar elements 202, 204 that can be mounted together for relative sliding movement in telescoping fashion. Thus, the bar elements can be extended or retracted in order to adjust the overall length L of the hanger, whereby the hanger can be adapted to different distances between the joists. It will be appreciated that if the length of each bar element were 14 inches, then by sliding the bar elements relative to one another, the overall bar length could be adjusted between roughly 14 and 25 inches (i.e., allowing for about 3 inches of overlap of the bar elements in the fully extended state).

If it is necessary to make the length less than 14 inches, it is conventional for the installer to break off a piece of each bar element. Heretofore, it has been necessary to disassemble the two bar elements from one another in order to be able to break off the pieces; then the bar elements must be reassembled.

Such disassembly and assembly is not necessary in connection with the present invention. As will be explained, the two bar elements 202, 204 can be retracted to a state in which their normally overlapping ends no longer overlap (as shown in FIGS. 20 and 21), whereby those ends are exposed and can be broken off.

The bar element 202, which may be considered a female part, includes a rail 206 and an attachment bracket 208 at one end of the rail. The attachment bracket 208, generally known in the art, includes a plate 210 projecting at a right angle from one side of the rail 206, the plate having an aperture 212. Integral with an upper edge 214 of the aperture is a barbed fastener member 216 which is adapted to be struck by a hammer to be driven through the aperture 212 and into a wooden joist.

The rail 206 is of generally C-shaped cross section (see FIG. 22), the C-shape being formed by a vertical wall 220, and upper and lower vertical lips 222, 224 disposed parallel to, and spaced from, the wall 220. Between the wall 220 and the lips 222, 224 there is formed a longitudinal channel 226. The upper and lower lips 222, 224 terminate in end faces 222', 224' which face downwardly and upwardly, respectively. Those end faces 222', 224' face one another and are spaced vertically apart to form therebetween an opening leading into the channel. The lower lip 224 includes a notch 230 formed therein intermediate the ends of the channel (see FIG. 21), the notch adapted to receive a tab 242 of the other rail, as will be explained.

The other bar element 204 includes a rail 232 having an attachment bracket 208' at one end thereof. That bracket 208' is essentially the same as the earlier described bracket 208 except that it includes a recess 234 (FIG. 19) for reasons to be discussed.

The rail 232 includes a projection 236 which extends into the channel 226, and upper and lower legs 238, 240 projecting upwardly and downwardly, respectively, from the projection. The legs 238, 240 are situated outside of the channel and extend alongside respective lips 222, 224. From FIG. 22 it will be appreciated that the end faces 222', 224' of the respective lips 222, 224 are arranged to engage upper and lower surfaces, respectively, of the projection 236.

Near the end 241 of the rail 232, the lower leg 240 becomes discontinuous, and a tab 242 (see FIGS. 20, 21, 22) projects downwardly from the projection 236 at a location spaced from the plane of the lower leg 240. At a location above the tab 242, the upper leg 238 is eliminated and instead there is a flange 244 extending upwardly from the projection and lying in the same plane as the tab 240.

To interconnect the bar elements 202, 204, the flange 244 is inserted upwardly through the channel opening in the direction R1 shown in FIG. 22 to enter the space formed between the wall 220 and the upper lip 222. Then the bottom portion of the rail 232 is swung toward the rail 202 in the direction R2, with the tab 242 disposed in alignment with the notch 230. Thus, the tab 242 will enter the channel 226 through the notch. The rails can now be slid longitudinally relative to one another, with the rail 232 held within the channel 226 by means of the flange 244 and the tab 242.

The wall 220 of the rail 206 includes a first bump 250 (FIG. 21) projecting into the channel 226 near an end 251 of the rail 206. The bump 250 lies in the path of travel of the tab 242 to prevent the rail 232 from being pulled longitudinally out of the rail 206.

Figure 18:
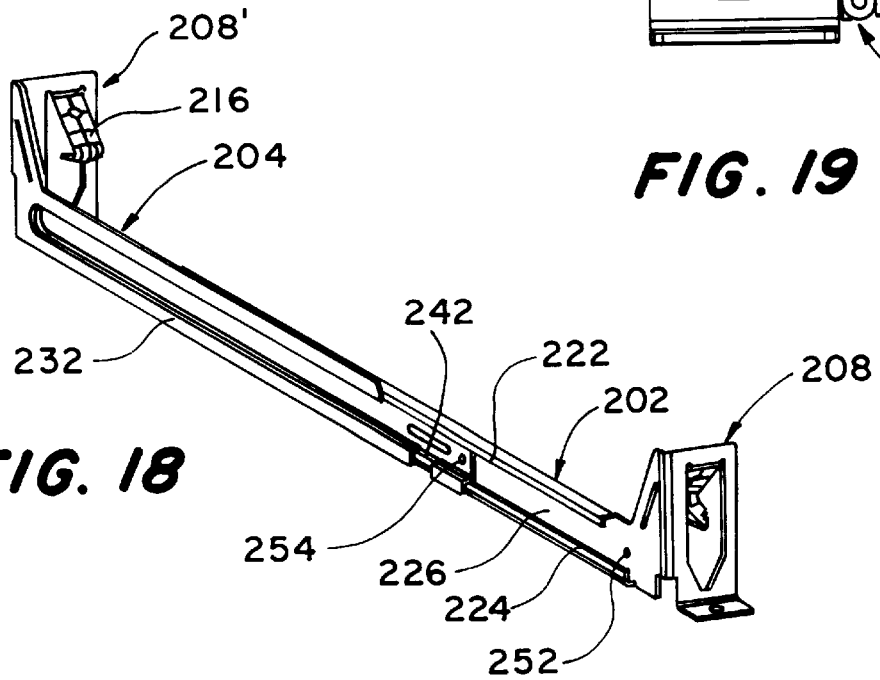
FIG. 18 is a perspective view of the bar hanger from a different direction.

Also projecting into the channel 226 from the wall 220 near the attachment bracket 208 is a second bump 252 (FIG. 18). The second bump 252 is adapted to be received in a hole 254 (FIG. 18) formed near the end 241 of the rail 232 to define a normally retracted state of the hanger. The rails 202, 204 are mounted together with sufficient looseness to permit the second bump 252 to come out of the hole 254. Accordingly, the rails can be slid beyond the normally retracted state whereby the rail ends 241, 251 travel out of a zone Z formed between the attachment brackets 208, 208' (see FIGS. 20 and 21). In such a state, an end portion of each rail is exposed and can be broken off.

As noted earlier, the plate 210 of the bracket 208' is provided with a recess 234 (see FIGS. 17, 19, 20) to enable the rail 206 to pass therethrough when it is desired to retract the hanger to a length shorter than the normally retracted length. A similar recess is not needed in the other bracket 208 because the rail 232 travels along a side of the rail 206 facing away from the direction in which the bracket 208 projects.

As noted above, when the bar elements 202, 204 have been retracted past the normally retracted state, the ends of the rails can be broken off. This is facilitated by the provision of score marks 260, 262 (FIG. 20) formed in the respective rails 232, 206, respectively.

It will be appreciated that in accordance with the inventive bar hanger, the length of the bar hanger 200 can be shortened by breaking off end pieces of the rails without having to disconnect the bar elements 202, 204 from one another, thus making the operation easier and faster for the installer.

Figure 23:
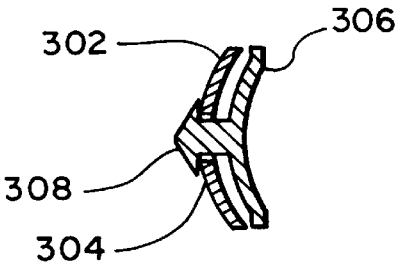
FIG. 23 (PRIOR ART)
FIG. 23 is a cross-sectional view taken through a first prior art bar hanger.

Furthermore, the sliding connection between the rails is achieved without the use of a longitudinal slot-and-tongue type of connection of the type shown in FIG. 23. In the hanger 300 shown in FIG. 23, one rail 302 has a longitudinally extending through-slot 304 formed therein. The other rail 306 includes a projection extending through the slot 304, the projection including an enlarged head to prevent the rails from becoming separated. The rails cannot be retracted past a normal retracted state as in the present invention. Furthermore, if parts of the rails are broken off, the break occurs through the slot, whereby the portions of the rail 302 situated above and below the slot are no longer interconnected, whereby the rigidity of the hanger is significantly lessened.

Figure 24:
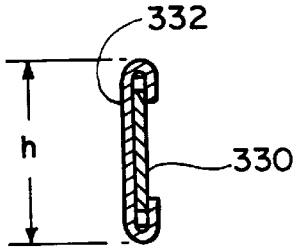
FIG. 24 (PRIOR ART)
FIG. 24 is a cross-sectional view taken through a second prior art bar hanger.

In another prior art hanger depicted in FIG. 24, a rail 330 slides within a channel formed by a C-shaped rail 332. However, the added rigidity afforded in the present invention by the engagement between the end faces 222', 224' with a rail projection is not present in FIG. 24. Also, the height h of the rail 332 in FIG. 24 is greater than the height of the other rail 330, whereas the rails 206, 232 of the present invention are of equal height H (FIG. 22). If the rails are of different heights, then the shorter rail would be too loosely disposed in its respective loops 14 (FIG. 1) since those loops are all of the same height. The present invention avoids that shortcoming.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A recessed light fixture comprising:

a frame;

a rotary device mounted in the frame for rotation relative thereto about a vertical axis;

a support member mounted to the rotary device for rotation therewith about the vertical axis, and for rotation relative thereto about a horizontal axis, the support member adapted to support a lamp for directing a beam downwardly through the rotary device, the direction of the beam being adjustable by rotation of the rotary device and the support member; and a stop structure for stopping rotation of the rotary device, the stop structure comprising a first stop element mounted on the rotary device, and a second stop element mounted on the frame, the first and second stop elements being engageable with one another for limiting rotation of the rotary device in both the clockwise and counterclockwise directions of rotation;

one of the first and second stop elements being movable by a limited extent to permit additional rotation of the rotary device after initial contact between the first and second stop elements has been made.

2. The light fixture according to claim 1 wherein the one of the first and second stop elements is the second stop element.

3. The light fixture according to claim 2 wherein the second stop element is rotatable about a vertical axis until engaging an outer edge of the rotary device to prevent further rotation of the stop.

4. The light fixture according to claim 3 wherein the second stop element is rotatable in two directions to enable the rotary device to travel an additional distance in both of the clockwise and counterclockwise directions.

5. The light fixture according to claim 4 wherein the second stop element includes a mounting portion pivotably mounted to the frame, and an engagement portion disposed higher than the mounting portion to form a step therebetween, the engagement portion overlying the rotary device; the step arranged to contact the outer edge of the rotary device.

6. A recessed light fixture comprising:

a frame having an upwardly facing top surface with an aperture formed therein and a mounting structure for use in attaching the recessed lighting fixture to ceiling joists;

a lamp support mechanism mounted on the frame and projecting above the aperture and the upwardly facing top surface of the frame, the lamp support mechanism configured to support a lamp to direct a light beam downwardly through the aperture; and a housing mounted on the upwardly facing surface of the frame for encasing the lamp support mechanism, a bottom end of the housing being bent laterally to form a flange having a downwardly facing surface extending completely around the perimeter of the bottom end and engaging the upwardly facing surface of the frame to retard the travel of air and promote a conduction of heat to the frame surface from inside of the housing.

7. The recessed light fixture according to claim 6 including fasteners extending through the flange and top surface for securing the housing to the frame.

8. A housing adapted for use in a recessed light fixture for encasing a lamp assembly, comprising:

a base including an upstanding wall structure including inner and outer upstanding wall sections spaced horizontally apart, the outer wall section forming an outer perimeter of the base, the inner wall section formed of metal, an upper end of the inner wall section being bent inwardly to form a horizontal flange;

a cover fastened to the base by fasteners, the cover including a horizontal wall structure formed by upper and lower wall sections, the lower wall section formed of metal and including:

a center portion spaced beneath the upper wall section and resting upon an upwardly facing surface of the flange for conducting heat to the inner wall section, and an outer peripheral portion disposed at a higher elevation than the center portion; and a thermally insulative gasket compressed between a downwardly facing surface of the cover and the upwardly facing surface of the flange for forming a continuous thermal seal between the lower and inner wall sections.

9. The housing according to claim 8 wherein the gasket is compressed between a downwardly facing surface of the outer peripheral portion of the lower wall section, and the upwardly facing surface of the flange.

10. The housing according to claim 8 further including another thermally insulative gasket compressed between an upwardly facing surface of the outer peripheral portion and a downwardly facing surface of the upper wall section.

11. The housing according to claim 10 wherein each of the fasteners extends through the upper wall section, the center portion of the lower wall section, and the flange.

12. A recessed light fixture comprising:

a horizontal frame having an aperture;

a spin disc mounted in the aperture for rotation about a vertical axis, the spin disc including a circular inner edge having more than two notches formed therein, the notches being non-equidistantly spaced apart, the inner edge including a downwardly projecting aiming tab; and a supporting mechanism adapted to support a lamp, the supporting mechanism including:

a ring disposed within the disc and carrying a plurality of spring clips connected within respective ones of the notches for fixing the ring to the spin disc for rotation therewith, and a supporting member including a table adapted to support a lamp for projecting a beam downwardly through the aperture, the supporting member mounted on the ring for rotation about a horizontal axis, whereby the light beam can be adjusted in the general direction of the aiming tab.

13. A recessed light fixture comprising:

a horizontal frame having an aperture;

a spin disc mounted in the aperture for rotation about a vertical axis, the spin disc including a pair of diametrically opposed guide channels, each guide channel including a pair of opposed vertical guide surfaces having an upwardly open notch formed in an upper end thereof;

a lamp supporting member mounted to the spin disc for rotation therewith and adapted to support a lamp assembly, the supporting member being rotatable about a horizontal axis to adjust an inclination of a light beam projected downwardly through the aperture; and a trim ring including a pair of diametrically opposed torsion springs, each torsion spring including a pair of legs elastically movable toward one another, each leg disposed in a respective one of the notches.

14. The recessed light fixture according to claim 13 wherein the guide surfaces are convergent in an upward direction.

15. The recessed light fixture according to claim 14 wherein each guide surface is of V-shaped cross section and includes portions converging toward a center thereof.

16. The recessed light fixture according to claim 13 wherein each leg of the torsion spring includes a free end having a bent portion forming a smooth corner for sliding along the guide surface.

17. A recessed light fixture comprising:

a horizontal frame having an aperture defining a vertical center axis;

a spin disc mounted in the aperture for rotation about a vertical axis;

a reflector mounted to the spin disc for rotation therewith and including an opening formed within a plane oriented at an oblique angle with respect to vertical, whereby the reflector includes tall and short sides opposing one another, the reflector including a bottom edge disposed in a horizontal plane intersected by the vertical axis at a point of intersection; and a supporting member supporting a lamp above the reflector and mounted to the spin disc for rotation therewith about the vertical axis and for rotation relative to the spin disc about a horizontal axis, the horizontal axis spaced from the vertical axis in a direction toward the tall side, whereby when the supporting member is rotated from a first position wherein a center axis of the light beam of the lamp extends vertically downwardly substantially through the point of intersection, to a second position wherein the lamp approaches the short side and the light beam becomes oriented obliquely relative to vertical, the lamp is moved closer to the point of intersection, while the center line of the beam continues to pass substantially through the point of intersection.

18. The recessed light fixture according to claim 17 wherein the horizontal axis is located below the horizontal plane containing the bottom edge of the reflector.

19. The recessed light fixture according to claim 17 wherein the horizontal axis is located above and close to the horizontal plane.

20. The recessed light fixture according to claim 17 wherein the horizontal axis is stationary.

21. The recessed light fixture according to claim 17 wherein the horizontal axis is movable as the supporting member rotates relative to the spin disc.

22. The recessed light fixture according to claim 17 further including a ring mounted on the spin disc for rotation therewith about the vertical axis, the ring carrying a pair of curved slots, the supporting member mounted for movement in the slots, the horizontal axis extending through the centers of curvature of the slots.

23. An adjustable-length bar hanger adapted to mount a light fixture frame to ceiling joists, comprising:

first and second bar elements interconnected for relative sliding movement in a longitudinal direction for selectively adjusting an overall length of the bar hanger, the first bar element comprising a first rail having a mounting end and a free end, the mounting end including a first bracket extending transversely of the longitudinal direction and adapted to be connected to a wooden ceiling joist, the second bar element comprising a second rail having a mounting end and a free end, the mounting end of the second rail including a second bracket extending transversely of the longitudinal direction and adapted to be connected to a wooden ceiling joist;

the first rail including a guide structure for guiding the second rail in longitudinal sliding movement relative thereto, with the free ends of the first and second rails overlapping each other in a zone defined between the first and second brackets, the guide means permitting the first and second rails to be slid relative to one another to a state where both of the first and second free ends extend beyond the zone, whereby the first and second free ends can be broken off to shorten the overall hanger length while the first and second bar elements remain in an interconnected state.

24. The bar hanger according to claim 23 wherein one of the first and second brackets includes a slot through which one of the rails extends when sliding the free end of a respective bar element beyond the zone.

25. The bar hanger according to claim 24 wherein the first rail forms a longitudinal channel defining the guide structure, the second rail including a portion slidably seated in the channel.

26. The bar hanger according to claim 23 wherein each of the first and second brackets includes an aperture and a barbed fastener joined integrally with an edge of the aperture, each fastener adapted to be hammered through the aperture and into a wooden joist.

27. The bar hanger according to claim 23 wherein each of the first and second rails includes score marks to facilitate the breaking-off of the free ends.

28. The bar hanger according to claim 23 wherein the first rail is of generally C-shaped cross section, the C-shape formed by a vertical wall and a pair of upper and lower vertical lips extending parallel to and spaced from the vertical wall, the upper and lower lips having respective lower and upper end faces facing one another and spaced vertically apart to form therebetween an opening leading to the channel; the second rail including a projection extending into the channel through the opening, and upper and lower vertical legs disposed outside of the channel and extending alongside the upper and lower lips, respectively, the lower and upper end faces of the upper and lower lips arranged to engage upper and lower surfaces, respectively, of the projection.

29. The bar hanger according to claim 28 wherein a vertical height of the first rail is substantially equal to a vertical height of the second rail.

30. An adjustable-length bar hanger adapted to mount a light fixture frame to ceiling joists, comprising:

first and second bar elements interconnected for relative sliding movement in a longitudinal direction for selectively adjusting an overall length of the bar hanger;

the first bar element comprising a first rail having a mounting end and a free end, the mounting end including a first bracket extending transversely of the longitudinal direction and adapted to be affixed to a wooden ceiling joist;

the second bar element comprising a second rail having a mounting end and a free end, the mounting end of the second rail including a second bracket extending transversely of the longitudinal direction and adapted to be affixed to a wooden ceiling joist;

the first rail including a longitudinal channel for guiding the second rail in longitudinal sliding movement relative thereto;

the first rail being of generally C-shaped cross section, the C-shape formed by a vertical wall and a pair of upper and lower vertical lips extending parallel to and spaced from the vertical wall, the upper and lower lips having end faces facing one another and spaced vertically apart to form therebetween an opening leading to the channel, the second rail including a projection extending into the channel through the opening, and upper and lower vertical legs disposed outside of the channel and extending alongside of the upper and lower lips, respectively, the end faces of the upper and lower lips arranged to engage upper and lower faces, respectively, of the projection.

* * * * *